United States Patent [19]

Shroyer

[11] Patent Number: 4,843,795

[45] Date of Patent: Jul. 4, 1989

[54] ALIGNMENT APPARATUS FOR IMPACT ALIGNMENT OF WEIGHED BATCHES OF ELONGATED OBJECTS

[75] Inventor: David Shroyer, Aurora, Oreg.

[73] Assignee: Lamb-Weston, Inc., Richland, Wash.

[21] Appl. No.: 193,033

[22] Filed: May 12, 1988

[51] Int. Cl.[4] ..... B65B 1/04

[52] U.S. Cl. ..... 53/236; 53/148; 53/525; 198/400; 198/560

[58] Field of Search ..... 53/167, 525, 544, 148, 53/236; 198/400, 560

[56] References Cited

U.S. PATENT DOCUMENTS

| | | | |
|---|---|---|---|
| 3,842,569 | 10/1974 | McClelland et al. | 53/525 |
| 4,146,123 | 3/1979 | Cottrell | 198/560 |
| 4,220,238 | 9/1980 | Shavit | 198/400 |
| 4,514,959 | 5/1985 | Shroyer | 53/428 |
| 4,586,313 | 5/1986 | Maglecic | 53/437 |
| 4,607,478 | 8/1986 | Maglecic | 53/502 |
| 4,693,355 | 9/1987 | Bochi et al. | 193/2 R |
| 4,777,907 | 10/1988 | Sanger | 198/400 |

*Primary Examiner*—W. Donald Bray

*Attorney, Agent, or Firm*—Klarquist, Sparkman, Campbell, Leigh & Whinston

[57] ABSTRACT

An alignment apparatus is disclosed for aligning weighed batches of elongated objects, such as French-fried potato strips. The batch of objects is weighed in a scale and discharged onto a moving conveyor belt which separates the objects and projects such objects from the conveyor into a vibrated alignment container. The objects impact a vertically-curved rear deflector wall of the alignment container in a direction substantially perpendicular thereto and may fall into contact with a straight front deflector wall so that they are aligned substantially parallel to such rear wall when they are discharged from such container. The objects fall freely by gravity through a drop tube from such alignment container for further separation and alignment into a packaging machine which packages the weighed batch of aligned objects.

18 Claims, 3 Drawing Sheets

ALIGNMENT APPARATUS FOR IMPACT ALIGNMENT OF WEIGHED BATCHES OF ELONGATED OBJECTS

BACKGROUND OF INVENTION

The subject matter of the present invention relates generally to alignment apparatus for the alignment of elongated objects and, in particular, to such apparatus which employs impact alignment to align weighed batchesof elongated objects prior to packaging. The present invention is an improvement on the alignment apparatus shown in U.S. Pat. No. 4,514,959 issued May 7, 1985, to David Shroyer. The alignment apparatus of the present invention is especially useful in aligning and packaging elongated food products, including French-fried potato strips.

An alignment apparatus is disclosed in U.S. Pat. No. 4,514,959 for aligning elongated objects by transmitting such objects along channels on a vibrating conveyor to partially align such objects before they contact the rear wall of an alignment container so that such objects strike such rear wall with their longitudinal axis at an acute angle. The elongated objects are thereby aligned substantially parallel to the rear wall of the alignment container and fall into such container where they are vibrated for further alignment and compaction until they reach a predetermined weight and are discharged as a weighed batch from the alignment container into a packaging machine. The present invention is faster, less expensive, and of more trouble-free operation than such prior apparatus while also being simpler and less expensive to manufacture. The present alignment apparatus differs therefrom by employing a conventional belt conveyor on which weighed batches of elongated objects are deposited and are caused to become separated by stream-out as they fall onto the moving belt conveyor, such objects being thrown off the end of the conveyor into impact with the curved rear deflector wall of a vibrated alignment container in a substantially perpendicular direction. The elongated objects then may fall into contact with a straight front deflector wall and are caused by such alignment container to be aligned substantially parallel with the rear wall of the alignment container when they are discharged from such alignment container into a drop tube. The elongated objects fall freely by gravity through such tube and are further aligned and separated before being discharged into a packaging machine where they are packaged as a weighed batch of aligned objects.

As is shown in U.S. Pat. No. 4,607,478, granted Aug. 26, 1986, and U.S. Pat. No. 4,586,313, granted May 6, 1986, to Steven C. Maglecic, it has previously been proposed to provide an alignment apparatus for packaging elongated objects after they are caused to free-fall through a tube, resulting in separation and partial alignment. However, these patents do not show impact alignment of elongated objects by projecting such objects off a rapidly-moving conveyor belt into impact contact with the rear wall of an alignment container in the manner of the present invention. In addition, it has been proposed to provide an automatic weighing apparatus for weighing batches of objects as shown in U.S. Pat. No. 4,693,355 of Bochi, et al., issued Sept. 15, 1987. Also, it is old to provide an apparatus for orienting randomly-distributed objects of a known shape, such as bottles or ampules, using a vibratory conveyor and an orienting device, as shown in U.S. Pat. No. 4,220,238 of Shavit, issued September 2, 1980. Finally, it is known to provide an automatic bagging apparatus for bagging batches of elongated food products, as shown in U.S. Pat. No. 3,842,569 of McClelland, et al., issued Oct. 22, 1974. However, none of these prior art apparatus employ an alignment apparatus for impact alignment of elongated objects by projecting weighed batches of such objects off the end of a rapidly-moving conveyor belt into impact with the rear wall of an alignment container in the manner of the present invention.

The present invention has several advantages over prior alignment apparatus, including fast, trouble-free operation which has less jam-ups. In addition, such invention produces packages of weighed batches of aligned, elongated articles which are compact and of a predetermined weight. Also, the present alignment apparatus is simpler and less expensive to manufacture than prior apparatus of this type.

SUMMARY OF THE INVENTION

It is, therefore, one object of the present invention to provide an improved alignment apparatus for aligning elongated objects in a fast, trouble-free manner which is less subject to jam-ups.

Another object of the invention is to provide such an improved alignment apparatus in which weighed batches of elongated objects are deposited on a moving belt conveyor and conveyed rapidly down such conveyor to separate such objects and to project them into impact with a deflector wall of an alignment container for causing such objects to become substantially aligned before they are discharged from such container.

An additional object of the invention is to provide such an alignment apparatus which is simple and less expensive to manufacture.

Still another object of the invention is to provide such an alignment apparatus in which the elongated objects are projected in a direction substantially perpendicular to a vertically-curved rear wall of the alignment container, such objects having a random orientation when they strike the rear wall of the alignment container, and leaving such container aligned substantially parallel to such rear wall.

A still further object of the invention is to provide such an alignment apparatus in which the aligned articles are discharged from the alignment container and free-fall by gravity through a drop tube into a packaging apparatus for further alignment and compaction of such articles prior to packaging.

DESCRIPTION OF DRAWINGS

Other objects and advantages of the present invention will be apparent from the following detailed description of a preferred embodiment thereof, of which.

DESCRIPTION OF PREFERRED EMBODIMENT

Figure 1:
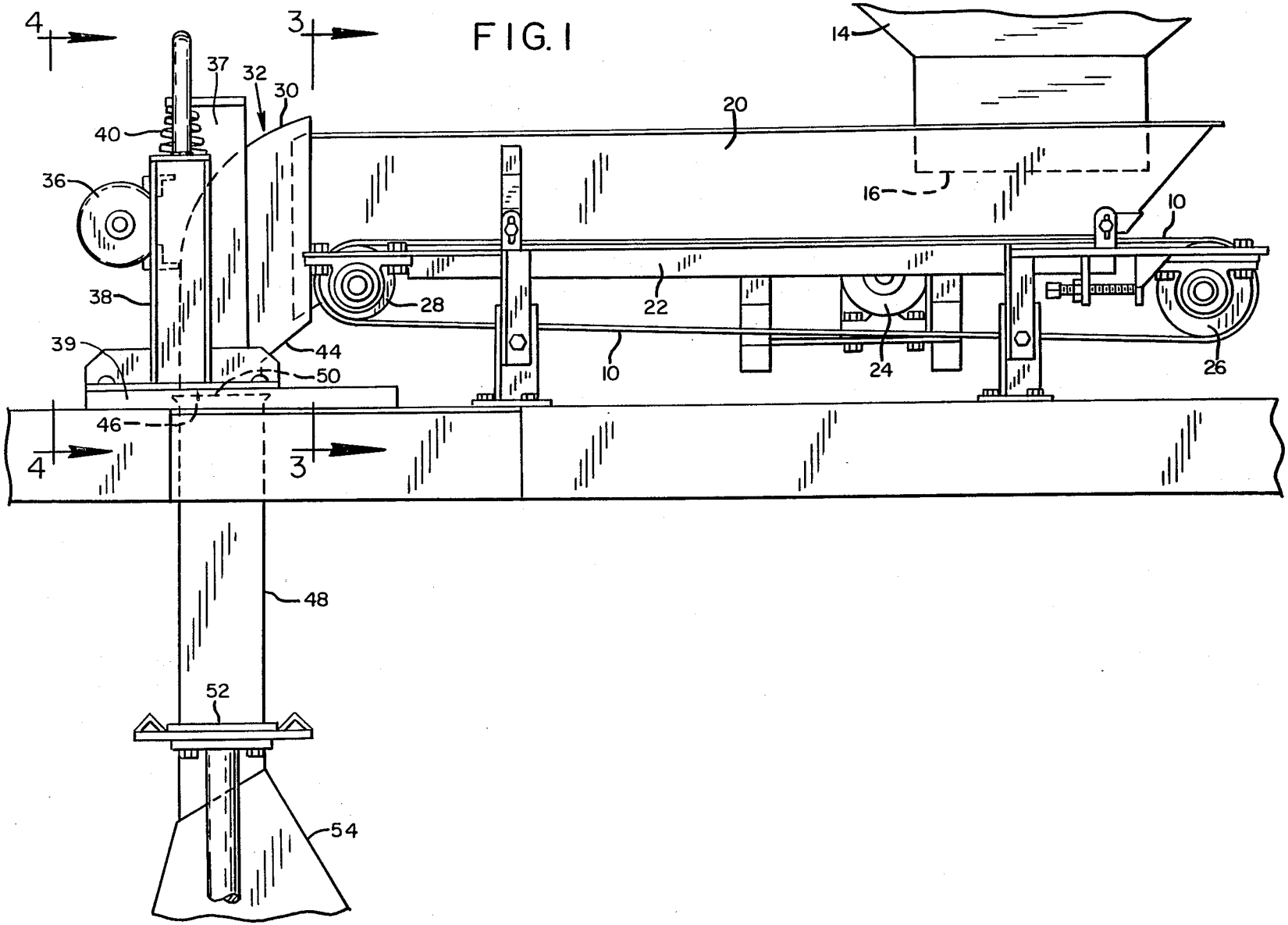
FIG. 1 is a side elevation view of an alignment apparatus in accordance with the present invention.
Figures 2, 5:
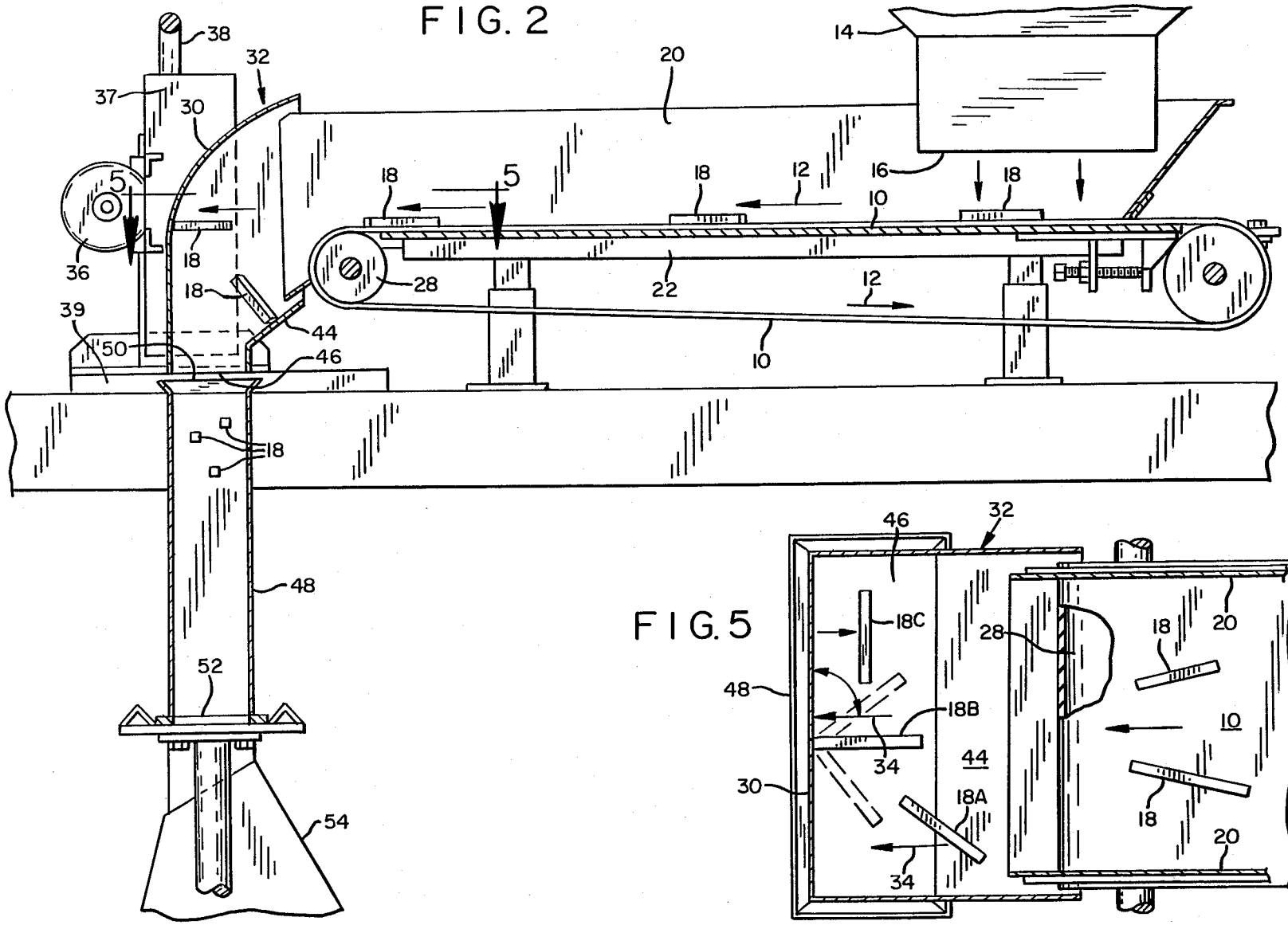
FIG. 2 is a longitudinal section view through the alignment apparatus of FIG. 1 showing the operation of such apparatus.
FIG. 5 is an enlarged horizontal section view taken along the line 5—5 of FIG. 2 showing the operation of the alignment container.
Figure 3:
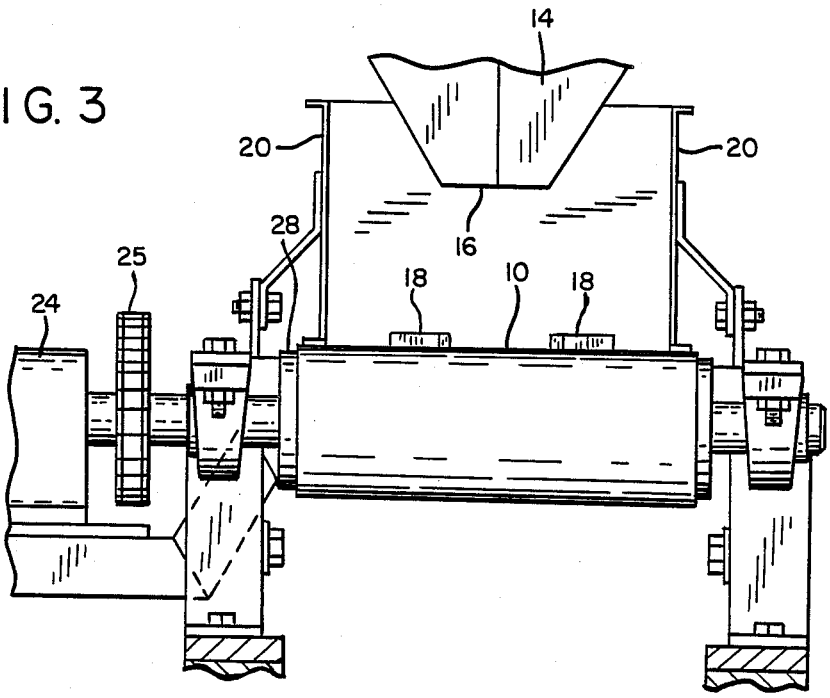
FIG. 3 is an enlarged vertical section view taken along the line 3—3 of FIG. 1 showing the conveyor mechanism.

As shown in FIGS. 1 and 2, the alignment apparatus of the present invention includes a belt conveyor 10 which rotates at a speed of approximately 250 to 300 feet per minute in the counterclockwise direction shown by arrows 12. A batch of elongated objects, such as French-fried potato strips or other food products, is weighed in a scale 14 and discharged through a gate 16 at the outlet of such scale to deposit such elongated objects 18 onto the top of the moving conveyor belt. As the objects fall upon the conveyor belt, they are separated by the streaming-out action of the conveyor belt to provide separated objects 18. A pair of conveyor side members 20 is fixedly mounted on opposite sides of the conveyor belt to form therewith a trough which maintains the elongated objects on the conveyor belt, such belt transporting the objects over a belt support plate 22 at the bottom of such trough. The conveyor belt is driven by a motor 24 whose output shaft is coupled by a chain 25 to an input roller 26 at the input end of the belt and/or to an output roller 28 at the output end of such belt, as shown in FIG. 3.

As shown in FIG. 2, when the elongated objects 18 are transported by the conveyor belt 10 past the output roller 28, they are projected off the end of the belt at a high speed of about 250 to 300 feet per minute into contact with a vertically-curved rear deflector wall 30 of an alignment container 32. As shown in FIG. 5, the elongated objects, or French-fried potato strips 18, are all projected from the conveyor belt 10 in a direction 34 substantially perpendicular to the rear wall 30 of the alignment container 32. However, such elongated objects are of a random orientation when they leave the conveyor belt before they strike the rear wall 30, as shown by objects 18A and 18B in FIG. 5.

Figure 4:
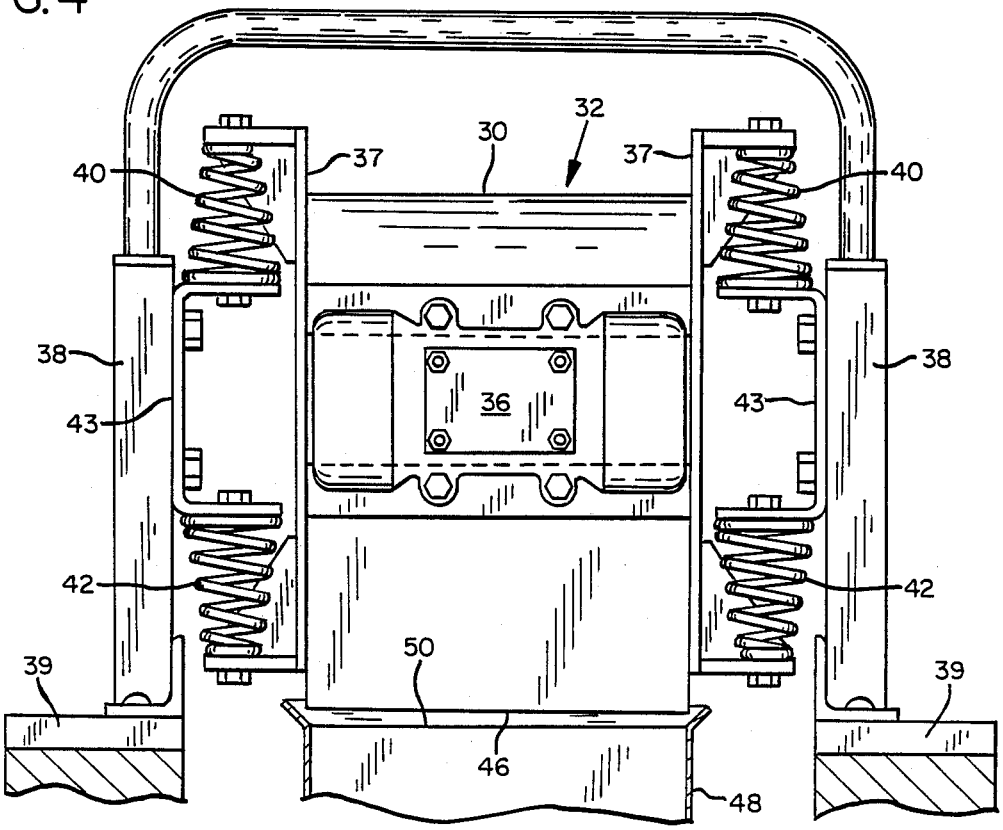
FIG. 4 is a vertical elevation view taken along the line 4—4 of FIG. 1 showing the vibration mechanism for the alignment container.

The alignment container 32 is vibrated by a vibrational motor 36 attached between a pair of brackets 37 which are fixed to such alignment container and are resiliently mounted on U-shaped support 38 attached to a frame 39, as shown in FIG. 4. Thus, the alignment container 32 is mounted on springs 40 and 42 which are attached to support 38 at the top and bottom, respectively, of such container by a U-bracket 43.

As shown in FIG. 2, the alignment container 32 includes a straight front deflector wall 44 which is inclined at an angle of approximately 45 degrees and is positioned below the vertically-curved rear wall 30 so that elongated objects striking such rear wall fall downward and may also strike the front wall 44. This causes the elongated objects to become aligned substantially parallel with the rear wall upon discharge of such objects through the outlet opening 46 of such alignment container, as shown by object 18C in FIG. 5.

A drop tube 48 is positioned vertically with its inlet opening 50 positioned below and in alignment with the outlet opening 46 of the alignment container 32. As a result, the aligned objects 18, discharged from the outlet opening 46 of the alignment container, fall freely by gravity through the drop tube 48, to the outlet opening 52 of such tube, where they are discharged into a packaging mechanism 54 of conventional type, such as that shown in U.S. Pat. No. 4,514,959 of Shroyer. Thus, the elongated objects 18 free-fall through tube 48 so that they are separated and more thoroughly aligned with their longitudinal axis approximately horizontal and parallel to each other. The objects leaving the tube 48 at outlet opening 52 are compacted into a batch of aligned elongated objects of predetermined weight which are packaged by the packaging mechanism 54. Unlike prior apparatus, there is no door or gate closing the outlet opening 46 of the alignment container 32 or the outlet opening 52 of the drop tube 48 which results in less jam-ups and faster operation of the alignment apparatus of the present invention.

It will be obvious to those having ordinary skill in the art that many changes may be made in the above-described details of the preferred embodiment of the present invention without departing from the spirit of the invention. Therefore, the scope of the present invention should be determined by the following claims.

I claim:

1. Alignment apparatus for impact alignment of elongated objects, comprising:

alignment means for aligning said elongated objects, including an alignment container having an inlet opening, an outlet opening, and a curved rear wall;

conveyor means for conveying elongated objects and for projecting said objects from said conveyor through the inlet opening of the alignment container in a direction which is substantially perpendicular to the curved rear wall to cause said objects to strike said curved wall and to be deflected by the impact; and vibrator means for vibrating said alignment container to cause the elongated objects to be aligned substantially parallel to said rear wall when they are discharged from said outlet opening at the bottom of said alignment container.

2. Alignment apparatus in accordance with claim 1 which also includes feeder means for feeding said elongated objects onto a moving conveyor belt forming said conveyor means in batches of objects of predetermined anounts.

3. Alignment apparatus in accordance with claim 2 in which the feeder means includes scale means for weighing said batches before they are fed onto the conveyor.

4. Alignment apparatus in accordance with claim 3 in which feeder means feeds the batches onto the conveyor means in a manner to cause the objects of each batch to become separated and spaced along said conveyor.

5. Alignment apparatus in accordance with claim 1 which also includes a drop tube whose top end is coupled to the outlet opening of the alignment container for receiving aligned objects from said outlet opening and causing said objects to fall freely downward in said drop tube to separate said objects and to discharge said objects from the bottom end of said drop tube.

6. Alignment apparatus in accordance with claim 5 which also includes packaging means for packaging the aligned objects, said bottom end of said drop tube discharging said objects into said packaging means.

7. Alignment apparatus in accordance with claim 1 in which the alignment container has a vertically-curved deflector wall position above a straight deflector wall so that objects deflected by the curved wall may also strike the straight wall.

8. Alignment apparatus in accordance with claim 1 in which the curved rear wall is curved vertically to provide a concave curved vertical surface against which the elongated objects are projected by the conveyor means.

9. Alignment apparatus in accordance with claim 1 in which the conveyor means includes a conveyor belt.

10. Alignment apparatus for impact alignment of elongated objects, comprising:

alignment means for aligning said elongated objects, including an alignment container having an inlet opening, an outlet opening, and a vertically-curved deflector wall;

conveyor means for conveying elongated objects and for projecting said objects from said conveyor through the inlet opening of the alignment container in a direction which is substantially perpendicular to the curved deflector wall to cause said objects to strike said curved wall and to be deflected by the impact and discharged from said outlet opening; and a drop tube whose top end is coupled to the outlet opening of the alignment container for receiving aligned objects from said outlet opening and causing said objects to fall freely downward in said drop tube to separate said objects and to discharge said objects from the bottom end of said drop tube.

11. Alignment apparatus in accordance with claim 10 which also includes feeder means for feeding said elongated objects onto said conveyor means in batches of objects of predetermined amounts.

12. Alignment apparatus in accordance with claim 11 in which the feeder means includes scale means for weighing said batches before they are fed onto the conveyor.

13. Alignment apparatus in accordance with claim 12 in which feeder means feeds the batches onto the conveyor means in a manner to cause the objects of each batch to be spaced along said conveyor.

14. Alignment apparatus in accordance with claim 10 which also includes vibrator means for vibrating said alignment container to cause the elongated objects to be aligned substantially parallel when they are discharged from said outlet opening at the bottom of said alignment container.

15. Alignment apparatus in accordance with claim 10 which also includes packaging means for packaging the aligned objects, said bottom end of said drop tube discharging said objects into said packaging means.

16. Alignment apparatus in accordance with claim 10 in which the alignment container has the curved deflector wall positioned above a straight deflector wall so that objects deflected by the curved wall may also strike the straight wall.

17. Alignment apparatus in accordance with claim 10 in which the curved deflector wall is curved vertically to provide a concave curved vertical surface against which the elongated objects are projected by the conveyor means.

18. Alignment apparatus in accordance with claim 10 in which the conveyor means includes a conveyor belt.

* * * * *